United States Patent [19]

Reber

[11] 4,185,578

[45] Jan. 29, 1980

[54] PRESSURE PLATE MINE SWEEP

[75] Inventor: Rufus K. Reber, Washington, D.C.

[73] Assignee: The United States of America as represented by the Secretary of the Navy, Washington, D.C.

[21] Appl. No.: 856,307

[22] Filed: Nov. 30, 1959

[51] Int. Cl.[2] ..... B63G 7/04

[52] U.S. Cl. ..... 114/245; 89/1 A; 114/254

[58] Field of Search ..... 114/235, 235.1, 235.2, 114/235.3, 236, 240, 240.1, 221, 244, 245, 253, 254

[56] References Cited

U.S. PATENT DOCUMENTS

| | | | |
|---|---|---|---|
| 2,353,360 | 7/1944 | Ronning | 114/253 X |
| 2,397,957 | 4/1946 | Freeman | 114/243 |
| 2,524,863 | 10/1950 | White | 114/244 |
| 2,610,240 | 9/1952 | Pottorf | 114/253 X |
| 2,709,981 | 6/1955 | Wilcoxon | 114/245 |
| 2,748,400 | 6/1956 | Kregall | 114/281 X |
| 2,890,672 | 6/1959 | Boericke | 114/274 |

*Primary Examiner*—David H. Brown

*Attorney, Agent, or Firm*—R. S. Sciascia; Q. E. Hodges

EXEMPLARY CLAIM

13. A minesweeping system comprising a pair of floats, means for towing the floats of said pair in laterally spaced relationship, a hydrofoil shaped pressure plate, and suspension means for suspending said pressure plate from said pair of floats, said suspension means including shock absorber means for eliminating shock caused by wave action on said floats.

19 Claims, 2 Drawing Figures

PRESSURE PLATE MINE SWEEP

Figure 2:
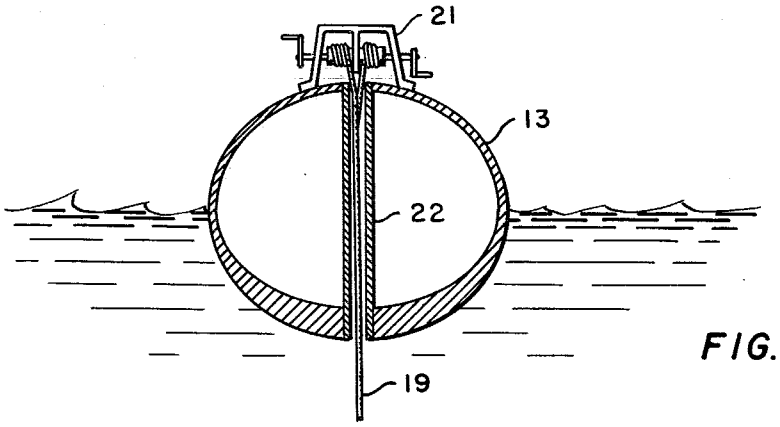

The invention described herein may be manufactured and used by or for the Government of the United States of America for governmental purposes without the payment of any royalties thereon or therefor.

The present invention relates to a pressure plate sweep for mines and more particularly to a pressure plate sweep wherein large free flooding hydrofoils are adjustably suspended from surface floats which, in turn, are attached to a towing craft.

Known types of mine sweeps include both rigid and flexible types which in general are expensive and difficult to maneuver.

One such sweeping system utilizes surface vessels such as towed barges which are difficult to maneuver and expensive since the barges must be considered expendable. Old ships have also been used for this purpose. Obviously these ships also must be considered expendable. Furthermore, surface vessels are ineffective for sweeping pressure mines in deep water.

Another device presently in use comprises an underwater parachute-like net which is towed through a mined area. The device is spread open by the water and the resultant pressure detonates some of the mines. Again the device has poor maneuverability and mine explosions as well as contact with underwater objects soon make the device unusable.

This type of device must be made of material having great tensile strength with resultant high cost. Furthermore the depth at which such devices may be effectively utilized is severely limited.

Rigid underwater devices towed from surface vessels have been tried but suffer from the difficulty of providing sufficient pressure over a large area. Further, the shock waves from mine explosions tend to cause severe bending forces on the rigid body which result in distortion and resultant damage or destruction in a very short time.

The present invention comprises a plurality of hydrofoils which may be transported in sections aboard ship and which are adapted to be assembled in the area in which they are to be used. The hydrofoils are designed to be towed in tandem to provide a pressure reduction over an extended period of time. The hydrofoils are of relatively large size so that they are effective at relatively large distances from the bottom.

Each hydrofoil is made of material which is relatively flexible and of relatively low cost. The hydrofoils are free flooding, that is, water is permitted to flow freely through the center of the foil thus providing strength in compression and resultant ability to withstand collapse.

The hydrofoils are suspended by means of cables, chains, or the like, from floats which have a small reserve buoyancy and which, in comparison with the towing craft, are relatively inexpensive. The small reserve buoyancy of the floats makes it possible to maintain stable operation of the sweeps even in relatively heavy seas and to obtain high resistance of the floats to shockwaves produced by underwater explosions. The cables or chains provide a convenient means for varying the angle of attack of the hydrofoils and to reach the required depth at a given towing speed.

The towing vessel for the floats may be virtually any desired distance ahead of the floats and thus well out of danger from damage due to underwater explosives.

It is an object of this invention to provide a minesweeping system which has a high degree of maneuverability.

A further object is the provision of a minesweeping system which is inexpensive as compared with known systems.

Another object is the provision of a minesweeping system which is more efficient than known systems particularly in deep water.

A still further object is to provide a system in which the depth of the sweep is adjustable between wide limits.

Figure 1:
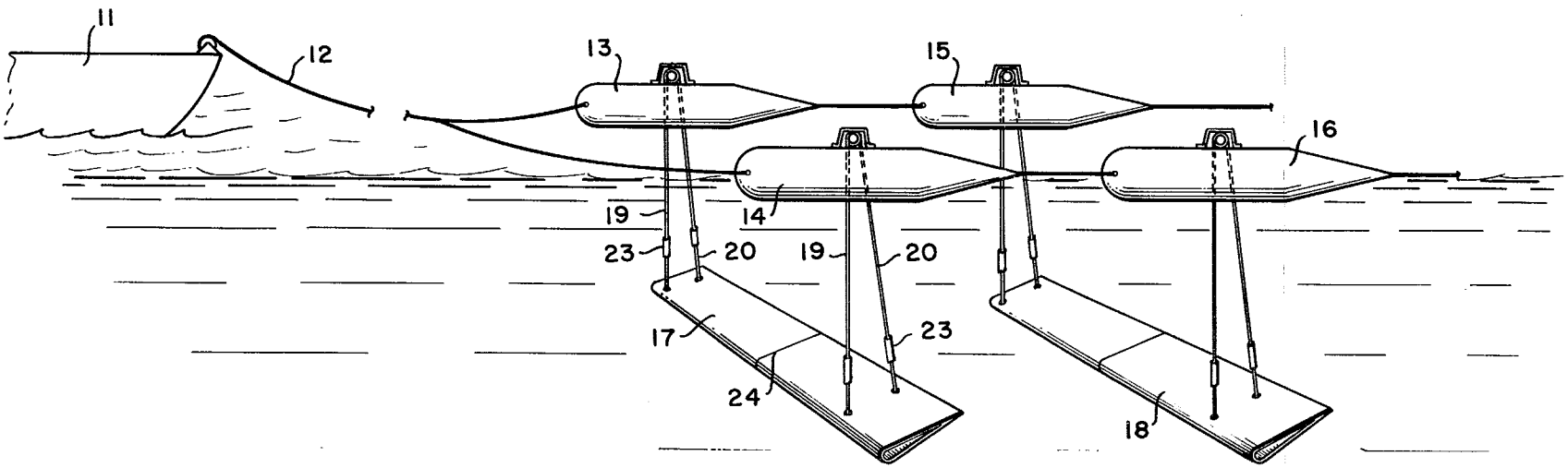

Other objects and advantages of the invention will hereinafter become more fully apparent from the following description of the annexed drawings, which illustrate a preferred embodiment, and wherein:

FIG. 1 is a diagrammatic view of a minesweeping system in accordance with the present invention; and FIG. 2 is a diagrammatic sectional view of one of the floats shown in FIG. 1.

Referring now to the drawings, wherein like reference characters designate like or corresponding parts throughout the several views, there is shown in FIG. 1 (which illustrates a preferred embodiment) a towing craft 11 to which are attached by means of cables or chains 12 a pair of floats 13 and 14.

The floats in general are hollow and have a semispherical nose, a cylindrical center portion and a conical shaped tail portion. the floats may be slightly elliptical in cross-section with the major axis of the ellipse parallel to the water plane as shown in FIG. 2. This provides an added degree of transverse stability which is required in rough water to keep the hydrofoils at a constant depth and to allow men to stand on the floats while making adjustments. As may be seen in FIG. 2, the shell of the bottom of the float is heavier than the top thus giving greater stability and explosion resistance.

Through each of the floats near the center thereof are a pair of tubes 22 through which cables 19 and 20 pass. The upper ends of the cables are shown attached to a winch arrangement 21 on top of the floats by means of which the cables may be shortened or lengthened to change the depth or angle of attack of the hydrofoils. It will be realized by those skilled in the art that any suitable means may be used to hold the cables at the desired length and that winch arrangement 21 is merely a possible configuration.

The other end of each of the suspension members 19 and 20 is attached to hydrofoil 17; member 19 near the leading edge and members 20 near the trailing edge. Thus it is possible to vary the angle of attack of the hydrofoil by varying the length of members 19 and 20. It will also be seen that since suspension members 19 and 20 pass through floats 13 and 14 near the center thereof and are closely spaced, pitching of the floats will have a very small effect on the hydrofoil 17, however, a shock absorber 23 is provided in each suspension member to absorb the shock load when the cables become taut after becoming slack due to wave action on the floats, particularly when at anchor.

Hydrofoil 17 has substantially the shape of an inverted airplane wing so that as it is towed through the water, the negative pressure will be below the hydrofoil. The shell and internal framework of the hydrofoil are made of material which has great strength as well as a high limit of elasticity and is relatively large in size; easier transportability being obtained by separating the sections at division 24. Full scale models measuring 20 feet in width by 100 feet in length and made either of plastic or steel and wood have been found satisfactory. Plastic was found to have a longer life but was more expensive than the wood and steel construction.

The hydrofoil is free flooding, that is it is open at the ends and the center of the hydrofoil is hollow, thus allowing the hydrofoil to fill with water when submerged. During the expansion and contraction of the gas bubble caused by an underwater explosion, the water near the explosion attains a very high velocity. If there is a hydrofoil near the explosion, the rapidly moving water tends to carry it along. Normally at this time, there is a large variation in velocity along the length of the hyrofoil so that considerable distortion in the shape of the hydrofoil will result causing both compressive and bending stresses on the hydrofoil structure.

An explosion in the plane parallel to the chord of the hydrofoil will have little bending effect since the hydrofoil presents a small area and is streamlined. However, if the explosion occurs directly below the hydrofoil maximum stresses are experienced by the hydrofoil. For this reason the material of the hydrofoil must be chosen to resist damage due to bending. By making the hydrofoil free flooding, a maximum resistance to compressive stress is obtained with a minimum of weight since the density of the hydrofoil is then nearly equal to the density of the water.

Also considered in the design of this invention is the fact that pressure mines must have a negative pressure signature for at least a given period of time. For this reason there is provided a second pair of floats 15 and 16 from which is suspended a second hydrofoil 18. This device is towed in tandem behind the first as shown in the drawing and by proper spacing from the first insures that a negative pressure is maintained for a much longer period of time due to the pressures produced by the two hydrofoils following one behind the other. Obviously more than two hydrofoils could also be utilized if necessary to provide a longer time of negative pressures. It will also be realized that by proper spacing the majority of mine explosions may be made to occur aft of the hydrofoils so as to give nearly minimum stress to the hydrofoils as outlined above.

Acoustic and magnetic sources may also be included with the pressure sources provided by the hydrofoils. One method of accomplishing this is to tow a conventional acoustic or magnetic source from the towing craft. Since pairs of separated floats are utilized in supporting the hydrofoils the acoustic and magnetic sources will not interfere with the floats.

Another alternative which has been found to be practical is incorporating the electrical leads in the towing cable and hydrofoil suspension members and incorporating a coil in the hydrofoil itself to generate the field at the depth of the hydrofoil.

Since the hydrofoils are quite large it has been found desirable to transport the hydrofoils in sections which are made detachable from each other. Thus the sections are assembled in the area in which the hydrofoil is to be used. This sectional construction also has the advantage that in the case of structural damage to a portion of the hydrofoil only the damaged section need be replaced.

Thus, there has been described a minesweeping system comprising a tandem arrangement of pressure plates suspended from towed floats and which may include acoustic and magnetic sources as well as the inherent pressure source. The system is efficient, versatile, highly maneuverable, and inexpensive compared with known systems.

It should be understood, of course, that the foregoing disclosure relates to only a preferred embodiment of the invention and that it is intended to cover all changes and modifications of the example of the invention herein chosen for purposes of disclosure, which do not constitute departures from the spirit and scope of the invention.

What is claimed is:

1. A minesweeping system for causing detonation of pressure sensitive mines, comprising a towing vessel, a first pair of floats towed behind said towing vessel, said floats being elliptical in cross-section with the major axis of the ellipse being parallel to the water plane, said floats having a shell which is substantially heavier at the bottom than at the top; a plurality of cables attached to said floats and extending downwardly therefrom, means on said floats for controlling the lengths of said cables which extend downwardly, shock absorber means in each of said cables, and a large free-flooding hydrofoil attached to said cables and suspended thereby, whereby as said hydrofoil is towed through the water by said towing vessel, a negative pressure is obtained thereby causing said pressure sensitive mines to be detonated.

2. The invention as defined in claim 1 wherein a second pair of floats carrying a second free flooding hydrofoil are towed in tandem behind said first pair of floats.

3. A minesweeping system for causing detonation of pressure sensitive mines, comprising a towing vessel, a first pair of floats towed behind said towing vessel, said floats having a shell which is substantially heavier at the bottom than at the top; a plurality of cables attached to said floats and extending downwardly therefrom, means on said floats for controlling the lengths of said cables which extend downwardly, shock absorber means in each of said cables, and a large free-flooding hydrofoil attached to said cables and suspended thereby, whereby as said hydrofoil is towed through the water by said towing vessel a negative pressure is obtained thereby causing said pressure sensitive mines to be detonated.

4. The invention as defined in claim 3 wherein a second pair of floats carrying a second free-flooding hydrofoil are towed in tandem behind said first pair of floats.

5. A minesweeping system for causing detonation of pressure sensitive mines, comprising a towing vessel, a first pair of floats towed behind said towing vessel, said floats being elliptical in cross-section with the major axis of the ellipse being parallel to the water plane, a plurality of cables attached to said floats and extending downwardly therefrom, means on said floats for controlling the lengths of said cables which extend downwardly, and a large free flooding hydrofoil attached to said cables and suspended thereby, whereby as said hydrofoil is towed through the water by said towing vessel a negative pressure is obtained thereby causing said pressure sensitive mines to be detonated.

6. The invention as defined in claim 5 wherein shock absorber means are included in each of said cables.

7. The invention as defined in claim 5 wherein a second pair of floats carrying a second free flooding hydrofoil are towed in tandem behind said first pair of floats.

8. A minesweeping system for causing detonation of pressure sensitive mines, comprising a towing vessel, a first pair of floats, means for towing said floats in spaced side-by-side relationship behind said towing vessel, said floats being elliptical in cross-section with the major axis of the ellipse being parallel to the water plane, said floats having a shell which is substantially heavier at the bottom than at the top; a large free flooding hydrofoil, and means for suspending said hydrofoil from said floats, said last named means including means for varying the angle of attack of said hydrofoil; whereby as said hydrofoil is towed through the water by said towing vessel a negative pressure is obtained thereby causing said pressure sensitive mines to be detonated.

9. The invention as defined in claim 8 wherein a second pair of floats carrying a second free flooding hydrofoil are towed in tandem behind said first pair of floats.

10. A minesweeping system comprising a plurality of floats, means for towing said floats in laterally spaced pairs, said pairs being towed in tandem, a plurality of hydrofoil shaped pressure plates, and suspension means for suspending each of said pressure plates from one of said pairs of floats, said suspension means including shock absorber means for eliminating shock caused by wave action on said floats.

11. The invention as defined in claim 10 wherein said suspension means further include means for varying the depth of each of said pressure plates.

12. The invention as defined in claim 11 wherein said suspension means further include means for varying the angle of attack of each of said pressure plates.

13. A minesweeping system comprising a pair of floats, means for towing the floats of said pair in laterally spaced relationship, a hydrofoil shaped pressure plate, and suspension means for suspending said pressure plate from said pair of floats, said suspension means including shock absorber means for eliminating shock caused by wave action on said floats.

14. The invention as defined in claim 13 wherein said suspension means further include means for varying the depth of said pressure plate.

15. The invention as defined in claim 14 wherein said suspension means further include means for varying the angle of attack of said pressure plate.

16. A minesweeping system comprising a plurality of floats, means for towing said floats in laterally spaced pairs, said pairs being towed in tandem, a plurality of hydrofoil shaped pressure plates, and suspension means for suspending each said pressure plate from one of said pairs of floats, said suspension means including means for varying the depth of each of said pressure plates and means for changing the angle of attack of each of said pressure plates.

17. The invention as defined in claim 16 wherein said hydrofoil shaped pressure plates are free flooding and wherein said floats are elliptical in cross-section, the major axis of the ellipse being parallel to the water plane.

18. A minesweeping system comprising a pair of floats, means for towing the floats of said pair in laterally spaced relationship, a hydrofoil shaped pressure plate, and suspension means for suspending said pressure plate from said pair of floats, said suspension means including means for varying the depth of said pressure plate and means for changing the angle of attack of said pressure plate.

19. The invention as defined in claim 18 wherein said hydrofoil shaped pressure plate is free flooding and wherein said floats are elliptical in cross-section, the major axis of the ellipse being parallel to the water plane.

* * * * *